US006939207B2

(12) United States Patent
Jensen et al.

(10) Patent No.: US 6,939,207 B2
(45) Date of Patent: Sep. 6, 2005

(54) METHOD AND APPARATUS FOR CONTROLLING CMP PAD SURFACE FINISH

(75) Inventors: Alan J. Jensen, Troutdale, OR (US); Mario Stella, Bedlington (GB); Eugene Zhao, San Jose, CA (US); Peter Renteln, San Ramon, CA (US); Jeffrey Farber, Delmar, NY (US)

(73) Assignee: Lam Research Corporation, Fremont, CA (US)

( * ) Notice: Subject to any disclaimer, the term of this patent is extended or adjusted under 35 U.S.C. 154(b) by 33 days.

(21) Appl. No.: 10/678,727

(22) Filed: Oct. 3, 2003

(65) Prior Publication Data

US 2004/0127144 A1 Jul. 1, 2004

Related U.S. Application Data

(63) Continuation of application No. 10/039,749, filed on Oct. 26, 2001, now Pat. No. 6,645,052.

(51) Int. Cl.[7] ..... B24B 1/00
(52) U.S. Cl. ..... 451/41; 451/56; 451/8
(58) Field of Search ..... 451/41, 5, 6, 7, 451/8, 21, 56, 72, 312, 443, 461, 446

(56) References Cited

U.S. PATENT DOCUMENTS

| | | | |
|---|---|---|---|
| 3,753,269 | A | 8/1973 | Budman |
| 4,318,250 | A | 3/1982 | Klievoneit et al. |
| 4,672,985 | A | 6/1987 | Mohr |
| 4,720,939 | A | 1/1988 | Simpson et al. |
| 4,934,102 | A | 6/1990 | Leach et al. |
| 5,081,051 | A | 1/1992 | Mattingly et al. |
| 5,335,453 | A | 8/1994 | Baldy et al. |
| 5,484,323 | A | 1/1996 | Smith |
| 5,527,424 | A | 6/1996 | Mullins |
| 5,531,635 | A | 7/1996 | Mogi et al. |
| 5,536,202 | A | 7/1996 | Appel et al. |
| 5,547,417 | A | 8/1996 | Breivogel et al. |
| 5,558,568 | A | 9/1996 | Talieh et al. |
| 5,575,707 | A | 11/1996 | Talieh et al. |
| 5,593,344 | A | 1/1997 | Weldon et al. |
| 5,611,943 | A | 3/1997 | Cadien et al. |
| 5,622,526 | A | 4/1997 | Phillips |
| 5,643,044 | A | 7/1997 | Lund |
| 5,655,951 | A | 8/1997 | Meikle et al. |
| 5,692,947 | A | 12/1997 | Talieh et al. |
| 5,692,950 | A | 12/1997 | Rutherford et al. |
| 5,708,506 | A | 1/1998 | Birang |
| 5,725,417 | A | 3/1998 | Robinson |

(Continued)

FOREIGN PATENT DOCUMENTS

| | | |
|---|---|---|
| WO | WO 98/45090 | 10/1998 |
| WO | WO 99/22908 | 5/1999 |
| WO | WO 01/32360 A1 | 5/2001 |

OTHER PUBLICATIONS

S. Inaba, T. Katsuyama, M. Tanaka, "Study of CMP Polishing pad Control Method," 1998 CMP–MIC Conference, Feb. 19–20, 1998, 1998 IMIC—300P/98/0444.

U.S. Appl. No. 09/540,602,: "Method and Apparatus for Conditioning a Polishing Pad"; Inventor: John M. Boyd; filed Mar. 31, 2000.

(Continued)

*Primary Examiner*—David B. Thomas
(74) *Attorney, Agent, or Firm*—Brinks Hofer Gilson & Lione

(57) ABSTRACT

A method and apparatus for pre-conditioning a polishing pad for use in chemical mechanical planarization of semiconductor wafers is described. The apparatus includes a pre-conditioning member having a smooth surface. The method includes providing a pre-conditioning member having a smooth surface, pressing the pre-conditioning member against the polishing pad while moving the polishing pad, and flattening the surface of the polishing pad until a polishing pad flatness is achieved that may be used to achieve a desired semiconductor wafer planarity.

17 Claims, 3 Drawing Sheets

U.S. PATENT DOCUMENTS

| | | | | |
|---|---|---|---|---|
| 5,759,918 | A | | 6/1998 | Hoshizaki et al. |
| 5,762,536 | A | | 6/1998 | Pant et al. |
| 5,779,526 | A | | 7/1998 | Gill |
| 5,871,390 | A | | 2/1999 | Pant et al. |
| 5,897,426 | A | | 4/1999 | Somekh |
| 5,899,798 | A | | 5/1999 | Trojan et al. |
| 5,908,530 | A | | 6/1999 | Hoshizaki et al. |
| 5,941,761 | A | | 8/1999 | Nagahara et al. |
| 5,958,794 | A | | 9/1999 | Bruxvoort et al. |
| 5,990,010 | A | | 11/1999 | Berman |
| 6,086,460 | A | | 7/2000 | Labunsky et al. |
| 6,273,798 | B1 | | 8/2001 | Berman |
| 6,300,247 | B2 | | 10/2001 | Prabhu |
| 6,306,019 | B1 | | 10/2001 | Finkelman |
| 6,309,277 | B1 | | 10/2001 | Arcayan et al. |
| 6,328,637 | B1 | | 12/2001 | Labunsky et al. |
| 6,361,409 | B1 | | 3/2002 | Vishwanathan et al. |
| 6,361,414 | B1 | | 3/2002 | Ravkin et al. |
| 6,395,194 | B1 | * | 5/2002 | Russell et al. ..... 252/79.1 |
| 6,413,145 | B1 | | 7/2002 | Pinson et al. |
| 6,475,069 | B1 | | 11/2002 | Thomas et al. |
| 2001/0015801 | A1 | | 8/2001 | Hirose et al. |

OTHER PUBLICATIONS

U.S. Appl. No. 09/607,743,: "A Conditioning Mechanism in a Chemical Mechanical Polishing Apparatus for Semiconductor Wafers"; Inventors: Vogtmann et al.; filed Jun. 30, 2000.

Copy of International Search Report for PCT/US02/31924 dated Jan. 20, 2003.

Copy of pending U.S. Appl. No. 10/100,740, entitled "Method And Apparatus For Conditioning Fixed–Abrasive Polishing Pads", filed Mar. 19, 2002.

* cited by examiner

METHOD AND APPARATUS FOR CONTROLLING CMP PAD SURFACE FINISH

CROSS-REFERENCE TO RELATED APPLICATIONS

This application is a continuation of U.S. application Ser. No. 10/039,749, filed Oct. 26, 2001, now U.S. Pat. No. 6,645,052, issued Nov. 11, 2003, which is hereby incorporated by reference herein.

FIELD OF THE INVENTION

The present invention relates to a method and apparatus for improving step height performance in a chemical mechanical planarization (CMP) process for semiconductor wafers. More particularly, the present invention relates to a method and apparatus for improving CMP performance by pre-conditioning the polishing pad surface finish.

BACKGROUND

Semiconductor wafers are typically fabricated with multiple copies of a desired integrated circuit design that will later be separated and made into individual chips. A common technique for forming the circuitry on a semiconductor wafer is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive for smaller, more highly integrated circuit designs which cannot tolerate certain nonuniformities within a particular die or between a plurality of dies on a wafer. Because semiconductor circuits on wafers are commonly constructed in layers, where a portion of a circuit is created on a first layer and conductive vias connect it to a portion of the circuit on the next layer, each layer can add or create nonuniformity on the wafer that must be smoothed out before generating the next layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. In some systems, a polishing fluid, such as a chemical polishing agent or slurry containing microabrasives, is applied to the polishing pad to polish the wafer. The wafer holder then presses the wafer against the rotating polishing pad and is rotated to polish and planarize the wafer. Some available wafer polishers use a linear belt rather than a rotating surface to carry the polishing pad.

With use, the polishing pads used in standard, chemical slurry CMP systems become smoothed and clogged with used slurry and debris from the polishing process. The accumulation of debris reduces the surface roughness and adversely affects polishing rate and uniformity. Polishing pads are typically conditioned to roughen the pad surface, provide microchannels for slurry transport, and remove debris or byproducts generated during the CMP process. Standard methods for conditioning this type of polishing pad may use a rotary disk embedded with diamond particles to roughen the surface of the polishing pad.

A goal of CMP for semiconductor wafers is to reduce the final step height of polished features on the semiconductor wafers. For example, integrated circuits are commonly built using a method known as Shallow Trench Isolation (STI). In STI, one circuit is isolated from another by creating a trench between the adjacent circuits and filling it with an insulator. The trench is known as a field and the circuit regions are known as the active regions. The insulator often is deposited or spun on uniformly over the field and active regions, and chemical mechanical planarization is subsequently used to flatten the surface.

Ideally, the higher topology regions (active regions) should be polished without polishing the lower topology regions (field). One problem with current CMP systems is that they can cause dishing on wafers where not only the higher, active regions on a wafers are polished, but the lower field regions are also polished so that an undesirably large "step height" remains between the active and field regions. Additionally, there is a need to reliably characterize a CMP process so that the improved step height performance may be repeated. Accordingly, further development of an apparatus and method for reducing step height variation and characterizing performance of equipment used in the chemical mechanical planarization of semiconductor wafers is desired.

DETAILED DESCRIPTION OF THE PRESENTLY PREFERRED EMBODIMENTS

Figure 1:
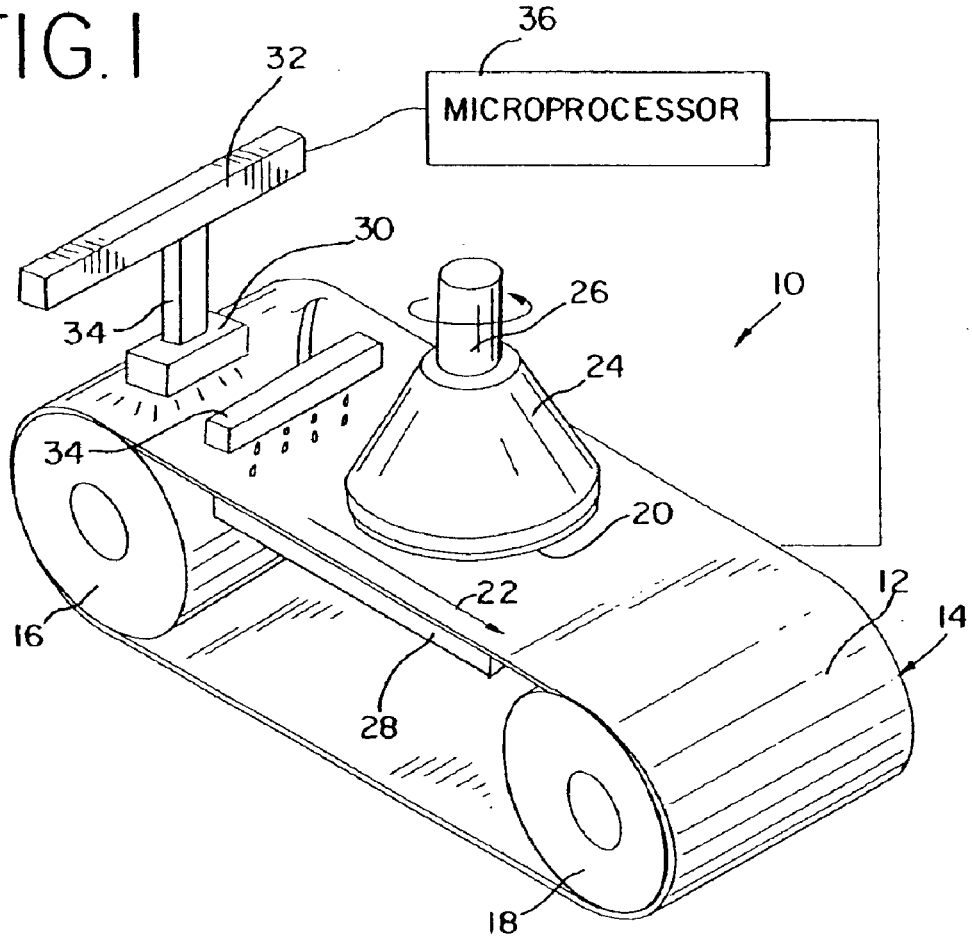
FIG. 1 is a perspective view of a linear polishing system for polishing or planarizing a semiconductor wafer incorporating a pre-conditioning member supported adjacent a polishing pad according to a preferred embodiment.

In order to address the deficiencies of the prior art, a method and apparatus is described below for improving general planarization efficiency and improving step height reduction while reducing dishing during a CMP process so that, for example, more field oxide remains during polishing of STI processed wafers. Referring to FIG. 1, a linear polisher 10 is shown that is suitable for use in pre-conditioning a polishing surface 12 in a belt assembly 14. The belt assembly 14 may consist of an integrally molded belt and pad combination or a belt having separate polishing pad and belt components attached in any one of a number of ways known in the art. The linear polisher 10 moves the belt assembly 14 linearly around rollers 16, 18 by actively driving one or both of the rollers 16, 18 with a driving mechanism such as a motor. In this manner, the polishing surface 12 of the polishing pad on the belt 14 moves past the surface of a pre-conditioning member 20 in a linear fashion. A direction of movement of the belt assembly 14 is indicated by arrow 22.

A pre-conditioning member carrier 24, driven by a spindle 26, holds the pre-conditioning member 20 against the polishing pad on the belt 14. A spindle drive mechanism (not shown) applies rotational and axial force to the spindle 26 so that the pre-conditioning member 20 is rotated and pressed against the polishing surface of the pad on the belt assembly 14. In other embodiments, the spindle may apply axial pressure to hold the pre-conditioning member against the pad while not rotating the pre-conditioning member. Alternatively, the spindle may simply be a piston or other non-rotatable mechanism capable of applying a desired force to the pre-conditioning member carrier to press the pre-conditioning member against the pad. A platen 28 positioned underneath the belt assembly 14 and opposite the pre-conditioning member carrier 24 supports the belt assembly with a fluid bearing to provide a very low friction surface that can be adjusted to compensate for polishing variations. A slurry dispenser 34, or dispenser for other types of polishing fluids, may be positioned adjacent the polishing surface of the pad. Suitable linear polishers include the linear polishers in the TERES CMP System available from Lam Research Corporation of Fremont, Calif. Additional details on suitable linear polishers, and wafer carriers suitable for use as pre-conditioning member carriers, may be found in U.S. Pat. Nos. 5,692,947 and 6,244,946, as well pending U.S. application Ser. No. 08/968,333 filed Nov. 12, 1997 and entitled "Method and Apparatus for Polishing Semiconductor Wafers", all of which are incorporated herein by reference.

A polishing pad topology scanner 30 may be mounted adjacent the polishing surface 12 of the polishing pad. The polishing pad topology scanner 30 may be a profilometer, such as the Surftest-SJ-301 available from Mitutoyo America Corporation of Aurora, Ill., or any other mechanism capable of measuring the topology of a polishing pad surface. Examples of some other suitable polishing pad topology scanners include phase shift microscopes and scanning electron microscopes. The topology scanner 30 may be mounted to the polisher 10 and oriented to scan a portion of the polishing pad surface. As shown in FIG. 1, the scanner 30 may be mounted to a shaft 34 that is position able at various positions over the polishing pad by an actuator 32, such as a linear motor, lead screw, piston and cylinder assembly, and other electrical or mechanical actuating device. In alternative embodiments, the topology scanner may be separate from the linear polisher and configured to receive the belt assembly 14 for a surface topology analysis of the polishing surface away from the polisher 10. The topology scanner preferably produces a topology scan signal representative of topology scan data for the polishing surface and sends that data to a microprocessor 36 that can determine the a pad flatness based on the topology scan signal. The microprocessor 36 is also preferably in communication with the wafer polishing device to control operation of the wafer polishing device in response to the topology scan signal. Any of a number of known programmable microprocessors may be used to manipulate the data in the topology scan signal and control operation of the wafer polisher.

The pre-conditioning member is attached to the pre-conditioning member carrier 24 and oriented to contact the polishing surface of the polishing pad. In one embodiment, the pad pre-conditioning member 20 is preferably formed as a single disk having an unbroken surface 38 that is configured to smooth the polishing surface of the polishing pad when pressed against a moving polishing pad for a period of time. In alternative embodiments, the pre-conditioning member may include multiple discrete components, in any one of a variety of individual shapes, that are juxtaposed to form the pre-conditioning member.

Figure 2:
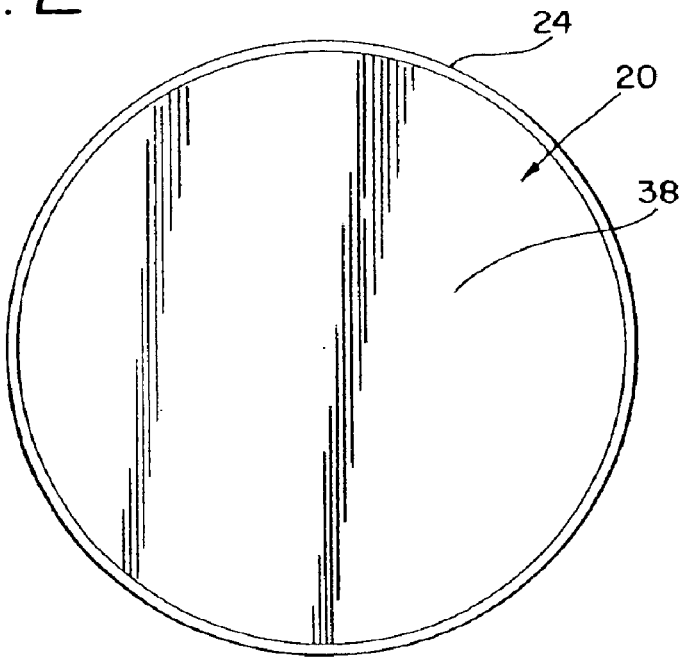
FIG. 2 is a bottom plan view of the pre-conditioning member and pre-conditioning member carrier of FIG. 1.
Figure 3:
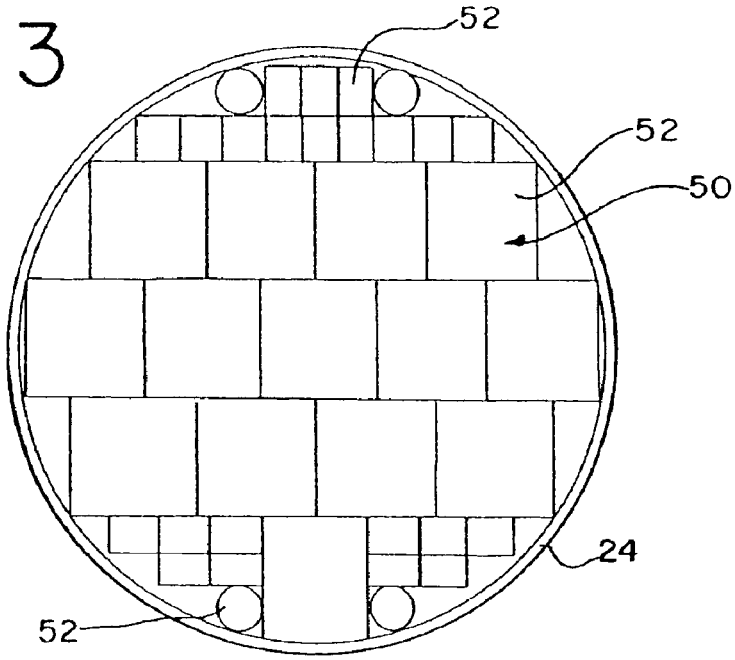
FIG. 3 is an alternative embodiment of the pre-conditioning member of FIG. 2.

An alternative embodiment of a pad pre-conditioning member 50 composed of various components is illustrated in FIG. 3. In this embodiment, the pre-conditioning member 50 includes a series of components 52 in the shape of bars and/or discs that are combined together and placed adjacent to each other in order to approximate the shape and size of a larger structure such as the disk of FIG. 2. As with the embodiment of FIG. 2, each surface of the multiple components is of a roughness which, when pressed against the polishing pad for a period of time at some down force will succeed in smoothing the pad and improving the planarization capability of the pad. In other preferred embodiments, the pad pre-conditioning member 20, 50 may be in the shape of a bar or other geometric shape. In yet other embodiments, the pre-conditioning member 20, 50 is structured to approximate the shape and size of a semiconductor wafer.

In one embodiment, and in contrast with the commonly available abrasive conditioners, the pad pre-conditioning member 20, or the discrete components that make up a pre-conditioning member 50, may be constructed of any material having a smooth, unbroken surface. The pre-conditioning member 20 may be an unpatented semiconductor wafer having a TEOS oxide film. Alternatively, the pre-conditioning member may be constructed of a quartz, silicon or magnesium oxide based material. Preferably, the pad pre-conditioning member is constructed of a material capable of maintaining a surface that is suitable for flattening the polishing pad surface. The pre-conditioning member may also be sandpaper having an aluminum oxide abrasive with a roughness of 320 grit, or finer. The preferred roughness of the pad pre-conditioning member is less than that of a diamond abrasive disk with randomly ordered diamonds embedded on a hard surface where the diamonds have a mean diameter of 60 micrometers, such as on polishing pad conditioners available from TBW Industries, Inc. of Furlong, Pa., however, the pre-conditioning member may be as smooth as the atomically smooth surface of a bare silicon semiconductor wafer. Because the pre-conditioning member is expected to become smooth with use, the exact material and flatness may be varied.

As described above, the pad pre-conditioning member 20 is mounted or attached onto the pre-conditioning member carrier 24, as illustrated in FIG. 1. Preferably, the pad pre-conditioning member 20 is attached to the pre-conditioning member carrier 24 using any attachment means know to those of skill in the art, such as a vacuum seal, retaining ring, a hook and loop type fastener (such as VELCRO™), a screw, a belt, a cable, a snap-fit member, an adhesive, a captivating spring, or any other type of means for attaching one member to a second member. In one embodiment, the pad pre-conditioning member 20 is removably attached to the pre-conditioning member carrier 24, however, the pad pre-conditioning member 20 may be fixedly attached to the pre-conditioning member carrier 24.

The pre-conditioning member carrier may be a semiconductor wafer carrier, such as the wafer carrier of the TERES polisher identified previously, or any standard gimbaled wafer carrier commonly known in the art. Alternatively, the pad pre-conditioning member 20 may be connected to other types of gimbal mechanisms. In one embodiment, the pre-conditioning member carrier may be connected with an actuator mechanism (not shown), that transports the spindle holding the pre-conditioning member carrier in a transverse direction to the linear direction 22 traveled by the belt assembly 14 and applies a downward force on the spindle against the belt assembly 14. Suitable devices for providing the transverse motion component and the down force component of the actuator mechanism include linear motors, lead screws, piston and cylinder assemblies, and other electrical or mechanical actuating devices. In another preferred embodiment, the actuator mechanism may also rotate the spindle while maintaining a downward pressure against the belt assembly and moving the pad conditioning member transverse to the rotational direction of the belt.

In operation, the pad pre-conditioning member 20 is in direct contact with a portion of the polishing surface of the polishing pad 14, as illustrated in FIG. 1. The pad pre-conditioning member 20 has a width or diameter D defined as the distance from one end of the pad pre-conditioning member 20 to the other, as illustrated in FIG. 2. According to a first preferred embodiment, the pad pre-conditioning member 20 has a width or diameter D that is at least as great as the diameter of the semiconductor wafers that the polishing pad will be later used to process. In another preferred embodiment, the pad pre-conditioning member 20 has a width or diameter D that is less than the diameter of the semiconductor wafer and is moved across the polishing surface by an actuator mechanism, such as mentioned above, to flatten an area at least as wide as the production wafers that will be processed with the polishing pad. Preferably, the pad pre-conditioning member 20 has a generally circular footprint on the polishing pad, as illustrated in FIG. 1. However, as would be appreciated by those of ordinary skill in the art, the pad pre-conditioning member 20 can form footprints with a variety of shapes such as a rectangular shape, a square shape, a v-shape, a w-shape, a u-shape, and any other regular or irregularly shaped footprint over the polishing pad 14.

Figure 4:
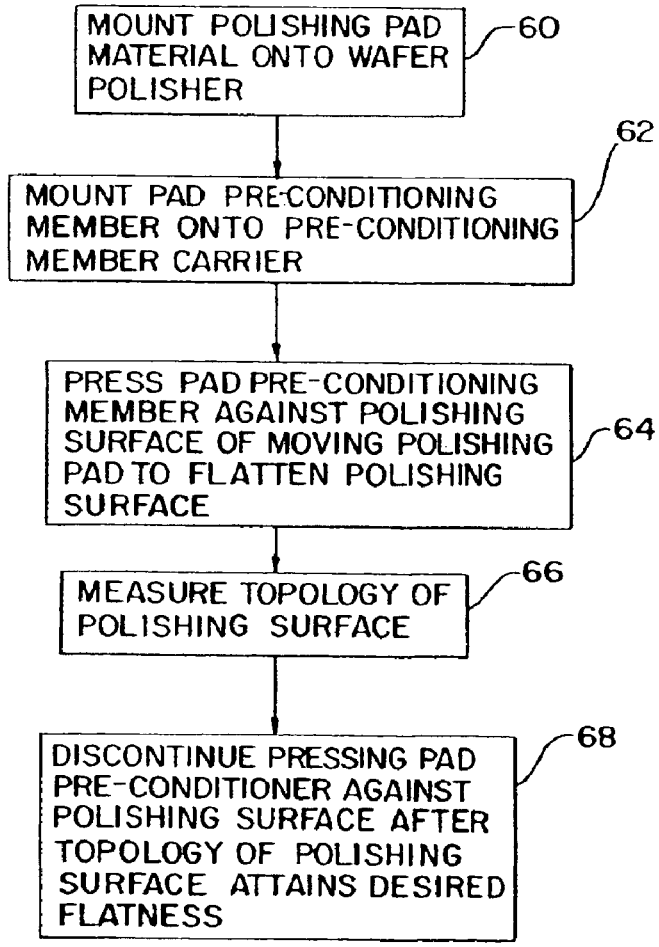
FIG. 4 is a flow chart illustrating a method of pre-conditioning a non-abrasive polishing pad according to a preferred embodiment.

Utilizing the apparatus described above, a preferred embodiment of a method for conditioning a polishing surface of a polishing pad will now be discussed. It should be understood that the process described below relates to pre-processing a non-fixed abrasive polishing pad (i.e. Ea polishing pad free of fixed abrasive particles) so that the polishing pad material, whether used with a linear, rotary, or some other form of CMP polisher, is reduced in roughness prior to putting the polishing pad into use to polish or plagiarize wafers. Referring to FIG. 4, a polishing pad assembly is mounted onto the wafer polisher (at 60). A pad pre-conditioning member is also mounted onto the pre-conditioning member carrier so that the pad pre-conditioning member is facing the polishing surface of the polishing pad assembly (at 62). Subsequently, the polishing pad assembly is moved on the wafer polisher and, while the polishing pad is in motion, the pad pre-conditioning member is pressed against the polishing surface to flatten the polishing surface (at 64).

The pad pre-conditioning process may be terminated after an adequate flattening of the polishing pad material has been achieved. The determination of adequate pad flatness may be made subjectively, such as through polishing patterned wafers with the pre-conditioned pad and determining if a desired improvement in the planarity achieved on the patterned wafers is obtained, or objectively, by measuring the surface of the pre-conditioned pad for a particular indict of pad flatness. The indict of pad flatness, examples of which are provided in more detail below, are measurements of the pad surface that correspond with pads that have been used to achieve a desired planarity on a patterned wafer. Referring again to FIG. 4, an embodiment of the method may include actively measuring the topology of the polishing surface to determine the flatness of the polishing surface (at 66). The measurement may be made on only one pad to determine the necessary time to flatten the specific type of pad and then the flattening of subsequent polishing pads may be achieved by repeating the process on subsequent identical type pads under identical conditions. Alternatively, the step of actively measuring the flatness may be carried out for each pad. The topology measurement may be made while the pad pre-conditioning member is being pressed against the surface, or the measurement may be made when the pad pre-conditioning member is positioned away from the polishing surface. Also, in alternative embodiments, the topology measurement may be made using a completely independently mounted topology scanner that is not connected to the wafer polisher or that requires removing the polishing pad assembly from the wafer polisher and positioning the polishing pad assembly adjacent the separately mounted topology scanner. The pad pre-conditioner is no longer applied to the polishing surface after the topology of the polishing surface attains a desired flatness (at 68). Preferably, no abrasive pad conditioner is applied to the polishing surface during the flattening (pre-conditioning) process.

In one preferred embodiment, the polishing surface of the polishing pad is comprised of a blown polyurethanes material, such as the IC 1000 polishing pad material from Model Corporation of Delaware. Although other polishing pad materials are contemplated, polishing pads with fixed-abrasive, also referred to as embedded abrasive, particles are not suitable for processing according to the disclosed embodiments. A linear wafer polisher such as the TERES CMP linear polisher system available from Lam Research Corporation of Fremont, Calif. May be used where the pre-conditioning member carrier is the wafer carrier where the pre-conditioning member is preferably a silicon wafer having a TEOS oxide deposition layer.

In one embodiment the linear wafer polisher is preferably run such that the polishing surface of the polishing pad is moving at approximately four hundred feet per minute while the pre-conditioning member is pressed against the belt at a pressure of approximately three pounds per square inch (p.s.i.) for 30 minutes. Additionally, a polishing slurry, such as SS-12 from Cabot Corp. May be used while the pre-conditioning member is pressed against the polishing surface where the slurry may be the same slurry as is used in the wafer processing for the type of wafer designated for processing on the polishing pad assembly. The use of water, no fluids or combinations and sequences of fluids/no fluids on the pad is also contemplated. In embodiments where an unpatented wafer of, for example, silicon having an oxide coating is used, the pad pre-conditioning may be accomplished by either applying the desired fluid or slurry compound while pressing the pre-conditioning against the pad, or by pre-wetting the pad and then pressing the pre-conditioning member against the pad with no fluids or slurry being added during the pre-conditioning process. In yet another embodiment, a completely dry process may be used if the pre-conditioning member is the fine grit, aluminum oxide sandpaper version described above. In this embodiment, no fluids are applied to the pad before or during application of the pre-conditioning member against the pad.

Other belt speeds, pressures and pre-conditioning times are also contemplated as these factors may vary depending on materials used and the desired pad flatness. Also, although a linear polishing device has been discussed, any apparatus capable of moving the polishing pad surface and pre-conditioning member relative to one another while maintaining a pressure between the pre-conditioning member and polishing pad surface is contemplated. Such alternative devices may include a rotary polishing apparatus, such as those available in the MIRRA MESA integrated CMP system available from Applied Materials, Inc. of Santa Clara, Calif. Furthermore, embodiments are contemplated where the polishing pad is mounted on a movable table, such as in the apparatus disclosed in U.S. Pat. No. 5,851,136, entitled Apparatus for Chemical Mechanical Polishing, the entirety of which is incorporated herein by reference. It is also contemplated that the polishing pad may be maintained in a fixed position while the pre-conditioner is moved along and against the polishing pad surface.

In one preferred embodiment, the flatness of the polishing pad that has been flattened using the pre-conditioning member may be determined according to the relation:

$$\text{Pad flatness ratio} = \frac{\text{polishing surface scan length} - \text{length of flat segments}}{\text{polishing surface scan length}}$$

Where the polishing surface scan length is total length of polishing surface scanned by the topology scanner. The polishing surface scan length may be any length of pad surface up to the entire length of the polishing pad. In the case of a rotary pad, the scan length is preferably the arc length at a desired radius of the pad, up to the circumference of the circle formed by a complete rotation of the rotary pad under the topology scanner. Preferably, the polishing surface scan length is at least 1 millimeter (mm), and more preferably in the range of 2 mm–5 mm. A flat segment is defined as a region within the polishing scan having at least a minimum length where the pad surface topology varies by no more than a certain amount from a predetermined height on the polishing surface.

In one preferred embodiment, the minimum length of a flat segment is preferably 40 microns and the height variation permitted within the 40 microns is no more than 2 microns. Thus, the length of the flat segments in the pad flatness ratio set forth above is a sum of lengths of all flat segments in the polishing surface scan length. With this definition, the pad flatness ratio will vary from zero to one. A pad flatness ratio of zero indicates a perfectly smooth surface. Any of a number of standard microprocessors may be used to communicate with the topology scanner to determine the pad flatness ratio and either automatically stop the pad flattening process when a desired ratio is achieved, as in the case where the topology scanner is associated with the polisher on which a pre-conditioner is operating, or simply generate a pad flatness ratio for use in characterizing polishing pads that have been pre-conditioned on separate device.

In an alternative embodiment, the process flattening the polishing surface with a pre-conditioning member may be controlled by characterizing the polishing surface by an average roughness using the topology scanner in much the same manner as described above. In this embodiment, rather than using the pad flatness ratio to determine the suitable stopping point of pad pre-conditioning, an average roughness is determined using the polishing surface scan data obtained by the topology scanner. Preferably, the polishing surface scan data contains general peak-to-valley distance measurements for points along the length of polishing surface scanned. These peak-to-valley measurements are then averaged and compared to an acceptable value to determine whether the polishing pad has been flattened enough to cease pre-conditioning the pad. A suitable roughness ratio for a polishing pad is at least one that is less than the average roughness of a new, untreated pad of the same type.

Preferably, for either method of characterizing pad flatness, the topology scanner scans a length of polishing surface in a direction substantially parallel to the direction of intended movement of the polishing pad. For example, with a linear polishing pad assembly as shown in FIG. 1, the scanning performed by the topology scanner to measure the polishing surface flatness would be executed along a line in a direction of movement of the polishing pad. In the case of a rotary polishing pad, the scan of the polishing pad surface topology would be made along an arch segment that is a constant radius away from the center of the rotary pad. In alternative embodiments, the scanning of the polishing pad surface topology may be made at non-parallel angles to the direction of motion of the polishing pad surface.

Figure 5:
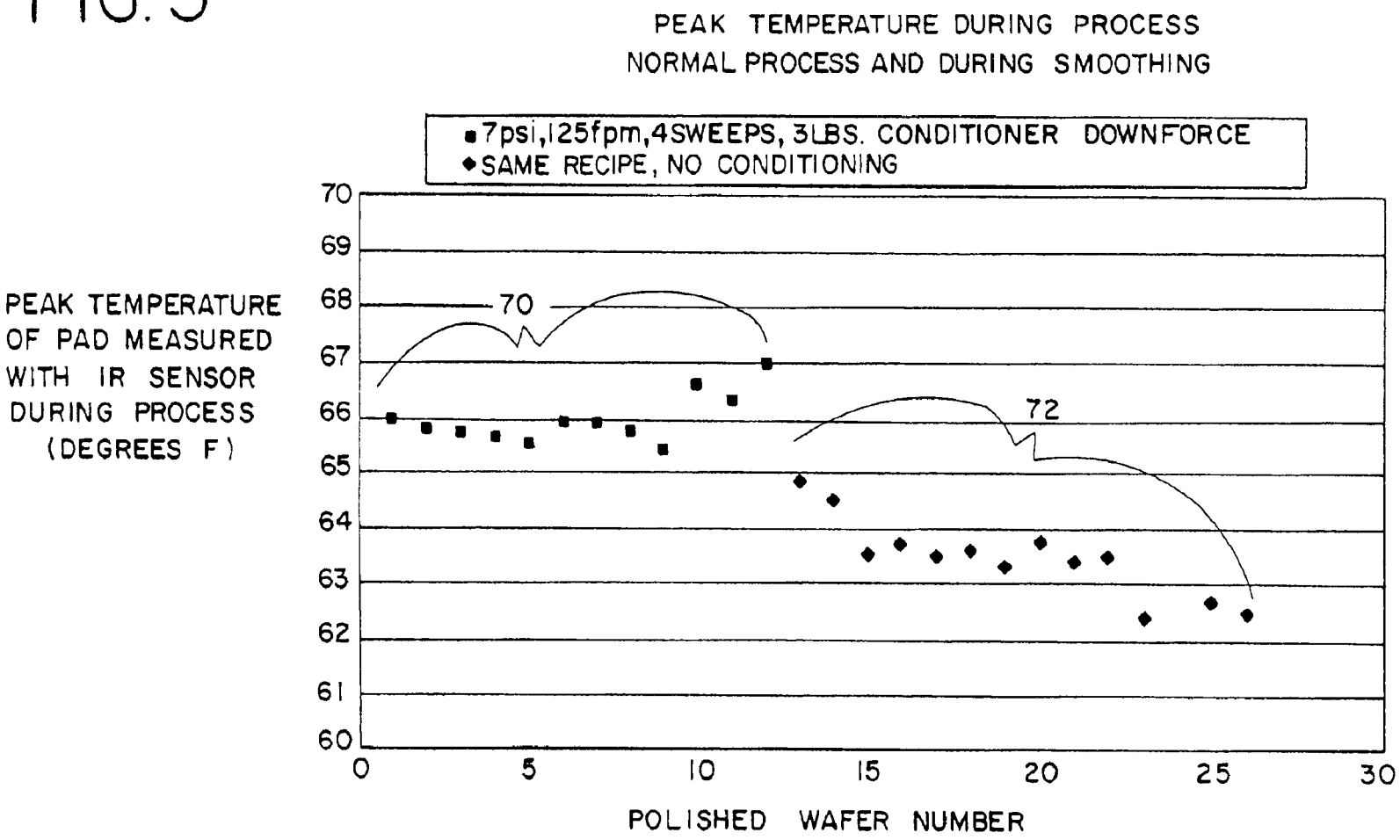
FIG. 5 is a graph illustrating peak temperature measurements of a pre-conditioned and non pre-conditioned pad.

In another embodiment, the topology scanner may be implemented as an infrared (IR) detector configured to measure the temperature of the portion of the pad that emerges from under the pre-conditioning member. Based on a comparison with pad temperatures of a pad that has not been pre-conditioned according to the method described above, an assessment may be made as to when the measured temperature on a pad being pre-conditioned is low enough to indicate a suitable pad flatness. FIG. 5 illustrates one example of peak temperature measurements 70 made with an IR sensor of a pad that has not been pre-conditioned and the peak temperature measurements 72 of the same pad during pre-conditioning.

In the example of FIG. 5, the first wafers are polished on the new pad (non-preconditioned) with a standard embedded diamond pad conditioner roughening the pad. As seen in FIG. 5, the peak temperature measurements 70 on the pad surface as it passes from under the wafer is on the order of 66 degrees Fahrenheit. When the standard conditioner is removed and a semiconductor wafer is used to smooth the pad surface, the peak temperature measurements 72 drop quickly at first and then continue to drop in smaller increments as subsequent wafers are pressed against the pad without the roughening pad conditioner until the peak temperature reaches roughly 62.5 degrees Fahrenheit. The pad temperature decreases as the pad becomes smoother and friction decreases.

As can be seen, the pad that was not pre-conditioned shows a higher temperature than the pre-conditioned pad under the same polishing conditions. An appropriate pad flatness may be noted by either an absolute temperature already determined as suitable for a specific pad type under given wafer polishing conditions, or by simply noting a temperature threshold of a non pre-conditioned pad and attaining a lower temperature for a pre-conditioned pad of the same type. The process of reducing the roughness of a new polishing pad preferably involves primarily flattening the polishing surface of the polishing pad and involves little or no removal/wear of the polishing pad material during the pre-conditioning process. The pre-conditioning process of reducing the roughness of a polishing pad may be performed at any time in the life of the polishing pad.

For example, a new polishing pad may be preconditioned according to the above-described process and that pad may be used in normal CMP processing for the remainder of its life, including use with standard pad conditioners that remove excess slurry and debris during standard slurry-based CMP processing, without requiring subsequent re-conditioning (flattening). Alternatively, a polishing pad that has already been used in a CMP process may be flattened according to the process described above and then reintroduced into CMP processing without need of any further flattening to maintain a desired improvement in step-height reduction on process semiconductor wafers. Preferably, a pre-conditioned polishing pad that is placed in service is subjected to lesser pressures by the standard conditioners so that, while still usable with standard pad conditioners in normal CMP processing, the polishing pad does not lose the benefit of the pre-conditioning that flattened the pad surface. In alternative embodiments, the amount of step height reduction improvement achieved using a pre-conditioned (flattened) polishing pad obtained using the devices and methods described herein may be adjusted by slightly re-roughening the pad surface with a standard abrasive pad conditioner.

Thus, unlike pad conditioners in abrasive slurry CMP applications, where highly abrasive pad conditioners (e.g. with diamond grit) are used to abrade the polishing pad surface, an embodiment of the present invention utilizes a relatively smooth surfaced pad pre-conditioning member to press down the polishing surface until the desired smoothness, which may be characterized by a pad flatness ratio in one embodiment, is achieved. By pressing down the non-abrasive polishing pad material in a manner to smooth and flatten the surface of the polishing pad material, step height reduction and planarization efficiency on patterned wafers is improved.

As has been described above, a method and apparatus for pre-conditioning a non-abrasive polishing pad material has been disclosed. The apparatus may consist of a conditioning member to be pressed against the polishing surface with the purpose of flattening the non-abrasive polishing surface of the polishing pad prior to processing patterned wafers. The method includes applying the surface of the conditioning member to the pad while moving the linear belt or rotary pad. A polishing fluid or slurry may be used in some embodiments or the pad may be pre-wetted or dry in other embodiments. The topology of the polishing surface may be monitored to determine if a desired pad flatness has been reached. The presently preferred method and apparatus has the advantage of improving the step-height reduction of a polishing pad on semiconductor wafers in a repeatable manner.

It is intended that the foregoing detailed description be regarded as illustrative, rather than limiting, and that it be understood that the following claims, including all equivalents, are intended to define the scope of this invention.

We claim:

1. A method for improving step height performance in a CMP process for polishing semiconductor wafers, the method comprising:

mounting a polishing pad onto a semiconductor wafer polisher and moving the polishing surface;

reducing a roughness of the polishing surface;

scanning a length of a polishing surface of the polishing pad and obtaining polishing surface scan data;

determining a polishing surface flatness from the polishing surface scan data; and discontinuing roughness reduction of the polishing surface when the determined polishing surface flatness reaches a desired polishing surface flatness.

2. The method of claim 1, wherein reducing the roughness of the polishing surface comprises pressing a pad pre-conditioning member against a portion of the polishing pad surface configured to receive a semiconductor wafer.

3. The method of claim 1, wherein reducing the roughness of the polishing surface comprises pressing a pad pre-conditioning member against a portion of the polishing pad surface configured to receive a semiconductor wafer while the polishing surface is moving.

4. The method of claim 2, wherein the pad pre-conditioning member comprises a semiconductor wafer.

5. The method of claim 4, wherein the semiconductor wafer comprises a TEOS oxide layer.

6. The method of claim 2, wherein the pad pre-conditioning member comprises a plurality of discrete elements.

7. The method of claim 1, wherein the polishing surface scan data comprises data containing peak-to-valley distance measurements for points along the length of polishing surface scanned, and wherein determining the polishing surface flatness from the polishing surface scan data comprises averaging peak-to-valley distance measurements and obtaining a roughness average.

8. The method of claim 7, wherein the desired polishing surface flatness comprises a roughness average of less than a roughness average of a polishing surface of an unused polishing pad.

9. The method of claim 2, wherein the pad pre-conditioning member comprises a non-abrasive material.

10. The method of claim 1, wherein reducing the roughness of the polishing surface comprises:

(a) applying pressure against the polishing surface with a non-abrasive pad pre-conditioning member;

(b) moving the polishing surface under the preconditioning member;

(c) applying a slurry to the polishing surface; and (d) maintaining steps (a)–(c) while keeping the polishing surface free of any abrasive pad conditioning device.

11. A method for pre-conditioning a polishing pad to improve planarity of semiconductor wafers subsequently processed in a CMP process using the polishing pad, the method comprising:

moving a polishing pad free of fixed abrasive particles;

flattening a polishing surface of the polishing pad with a pre-conditioning member; and applying a fluid to the polishing pad while flattening the polishing surface.

12. The method of claim 11, wherein the pre-conditioning member comprises a semiconductor material.

13. The method of claim 11, wherein the pre-conditioning member comprises sandpaper.

14. The method of claim 11, further comprising measuring a flatness criteria of the polishing surface after flattening the polishing pad, polishing a semiconductor wafer with the polishing pad, measuring a planarity of the semiconductor wafer after polishing the semiconductor wafer with the polishing pad, and flattening at least one additional polishing pad until the measured flatness criteria is achieved if the planarity of the semiconductor wafer is a desired planarity.

15. A method for pre-conditioning a polishing pad to improve planarity of semiconductor wafers subsequently processed in a CMP process using the polishing pad, the method comprising:

moving a polishing pad free of fixed abrasive particles;

flattening a polishing surface of the polishing pad with a pre-conditioning member; and measuring a flatness criteria of the polishing pad.

16. The method of claim 15, wherein measuring the flatness criteria comprises measuring a temperature of the polishing surface while flattening the polishing surface.

17. A method for pre-conditioning a new polishing pad to improve planarity of semiconductor wafers subsequently processed in a CMP process using the polishing pad, the method comprising:

applying a pre-conditioning member to the new polishing pad, wherein the new polishing pad is free of fixed abrasive particles;

flattening a polishing surface of the new polishing pad with the pre-conditioning member to reduce a roughness of the polishing surface;

measuring a surface flatness of the polishing surface; and discontinuing the flattening of the polishing surface when a desired surface flatness is attained.

* * * * *